US007621623B2

(12) United States Patent
Umeda

(10) Patent No.: US 7,621,623 B2
(45) Date of Patent: Nov. 24, 2009

(54) RECORDING HEAD AND INKJET RECORDING APPARATUS

(75) Inventor: Takaichiro Umeda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 422 days.

(21) Appl. No.: 11/529,878

(22) Filed: Sep. 28, 2006

(65) Prior Publication Data

US 2007/0165085 A1 Jul. 19, 2007

(30) Foreign Application Priority Data

Sep. 28, 2005 (JP) ..... 2005-282344

(51) Int. Cl.
*B41J 2/045* (2006.01)

(52) U.S. Cl. ..... 347/68

(58) Field of Classification Search ..... 347/71, 347/72, 70, 68, 69

See application file for complete search history.

(56) References Cited

U.S. PATENT DOCUMENTS 5,969,738 A 10/1999 Tomikawa et al.

2005/0041074 A1* 2/2005 Watanabe et al. ..... 347/71

FOREIGN PATENT DOCUMENTS

JP 9-183230 7/1997

* cited by examiner

*Primary Examiner*—K. Feggins
(74) *Attorney, Agent, or Firm*—Reed Smith LLP

(57) ABSTRACT

A recording head includes: an ink reservoir; ejection nozzles; and at least one ink supply path through which ink, reserved in the ink reservoir, is supplied to the ejection nozzles. The ink supply path includes: a pressure chamber having a piezoelectric element for changing pressure inside of the ink supply path for ejecting ink in the ink supply path from the ejection nozzles; a restriction part disposed between the ink reservoir and the pressure chamber for inhibiting ink in the pressure chamber from reversely flowing toward the ink reservoir; and a coupling portion connecting the pressure chamber and the restriction part. The restriction part, the coupling portion, and the pressure chamber are designed such that size the ink supply path becomes larger in order of the restriction part, the coupling portion, and the pressure chamber.

17 Claims, 6 Drawing Sheets

15
15d
15d
15d
15d
M
C
Y
K
14
14
14
14
4
4
4
4
15
15a
15f
15b
15c
15e
15d
14
4
17
16
11
INK SUPPLY DIRECTION
12
PUMP
13

RECORDING HEAD AND INKJET RECORDING APPARATUS

CROSS-REFERENCE TO RELATED APPLICATION

This application claims the benefit of Japanese Patent Application No. 2005-282344 filed Sep. 28, 2005 in the Japan Patent Office, the disclosure of which is incorporated herein by reference.

BACKGROUND

This invention relates to a recording head which ejects ink from ejection nozzles and performs image recording on a recording medium. The present invention also relates to an inkjet recording apparatus including such recording head.

As the above-described inkjet apparatus, inkjet recording apparatus having a function, wherein air entered an ink supply path, connecting an ink tank and ejection nozzles, is removed, have been conventionally known. Especially among such inkjet recording apparatus, there are inkjet apparatus including an ink supply path, wherein a sectional area of the upper portion of the path is larger than that of the lower portion. In this kind of inkjet recording apparatus, the flow speed of ink in the upper portion of the ink supply path is relatively low, and air (air bubbles) do not easily move from the upper portion of the path to the lower portion.

Generally, in an inkjet recording apparatus, an ink supply path, connecting an ink tank and ejection nozzles, is provided with a pressure chamber and a restriction part. The pressure inside of the pressure chamber becomes high due to a piezoelectric element. The restriction part inhibits ink from reversely flowing toward the ink tank. That is, the sectional area of the restriction part is configured to be smaller than that of the pressure chamber. Because of this restriction part, the resistance generated when ink flows becomes large, and the reverse flow of ink is inhibited.

In the above-described conventional inkjet recording apparatus, the configuration is devised in the ink supply path from the restriction part toward the side of the ink tank. Therefore, when air enters the restriction part, an air removal process is required in order to remove the air.

In a recent inkjet recording apparatus, an ink supply path is disposed in a bent manner in order to make the size of the entire apparatus small. In such inkjet recording apparatus, air is easily accumulated in the bent portion. In order to remove the accumulated air, ink in the bent portion needs to be moved at relatively high speed.

As a result, there has been a problem that a large amount of ink is wasted so as to remove air inside of an ink supply path.

In consideration of the above and other problems, in a recording head and an inkjet recording apparatus, air accumulated in the ink supply path is preferably removed merely by discharging as small amount of ink as possible.

SUMMARY

In one aspect of the present invention, a recording head includes: an ink reservoir that reserves ink; ejection nozzles that eject ink; and at least one ink supply path through which ink, reserved in the ink reservoir, is supplied to the ejection nozzles. The ink supply path includes: a pressure chamber provided with a piezoelectric element for changing pressure inside of the ink supply path in order to eject ink in the ink supply path from the ejection nozzles; a restriction part disposed between the ink reservoir and the pressure chamber so as to inhibit ink in the pressure chamber from reversely flowing toward the ink reservoir; and a coupling portion connecting the pressure chamber and the restriction part. The restriction part, the coupling portion, and the pressure chamber are designed such that sizes of respective portions of the ink supply path become larger in order of the restriction part, the coupling portion, and the pressure chamber.

That is, in such recording head, even when air (air bubbles) is accumulated in respective joint portions of the restriction part, the coupling portion, and the pressure chamber, air bubbles do not grow to be in a size equal to or larger than spaces formed by the restriction part, the coupling portion, and the pressure chamber.

Therefore, according to such recording head, the size of an air bubble, which can exist in the spaces formed by the restriction part, the coupling portion, and the pressure chamber, may be limited. The resistance generated when air bubbles, which have entered the restriction part or the coupling portion, are moved may be reduced. As a result, air (air bubbles) accumulated in the ink supply path may be removed simply by discharging a small amount of ink.

In another aspect of the present invention, a recording head including: an ink reservoir that reserves ink; ejection nozzles that eject ink; and at least one ink supply path through which ink, reserved in the ink reservoir, is supplied to the ejection nozzles. The ink supply path including: a pressure chamber provided with a piezoelectric element for changing pressure inside of the ink supply path in order to eject ink in the ink supply path from the ejection nozzles; a restriction part disposed between the ink reservoir and the pressure chamber so as to inhibit ink in the pressure chamber from reversely flowing toward the ink reservoir; and a coupling portion connecting the pressure chamber and the restriction part. A depth of the coupling portion, which is a size of the coupling portion in a depth direction parallel to an ink flow direction in the pressure chamber, is smaller than a height of the coupling portion, which is a size of the ink supply path in the coupling portion in an up-and-down direction parallel to the ink flow direction in the coupling portion.

The height of the coupling portion in the present invention is a size including the height of the restriction part, which is the size of the restriction part in the up-and-down direction, and the height of the pressure chamber which is the size of the pressure chamber in the up-and-down direction.

In the above-described recording head, even when air (air bubbles) is accumulated in respective connecting portions of the restriction part, the coupling portion, and the pressure chamber, air bubbles do not become larger than the space constituted with the restriction part, the coupling portion, and the pressure chamber (the space defined by the depth of the coupling portion and the height of the coupling portion).

In the above-described recording head, the same effect can be achieved as in the recording head described earlier.

In further aspect of the present invention, an inkjet recording apparatus, having one of the above-described recording heads, is provided.

BRIEF DESCRIPTION OF THE DRAWINGS

The invention will now be described below, by way of an example, with reference to the accompanying drawings, in which:

FIGS. 3A and 3B are explanatory views in which FIG. 3A shows a sectional side view of an ink supply mechanism of the inkjet recording apparatus according to the embodiment, and in which FIG. 3B shows a sectional top view of a recording head of the inkjet recording apparatus;

DETAILED DESCRIPTION OF THE PREFERRED EMBODIMENT

[Description of Overall Structure of Inkjet Recording Apparatus]

An inkjet recording apparatus 1 is a so-called multifunction device (MFD) including a printer function, a copier function, a scanner function, and a facsimile function. A sheet of paper, a plastic film, or the like is used as a recording medium. The inkjet recording apparatus 1 according to the present embodiment can perform monochrome image recording when the apparatus 1 functions as a facsimile. The inkjet recording apparatus 1 can perform color and monochrome image recording when the apparatus 1 functions as a printer and a copier.

Figure 1:
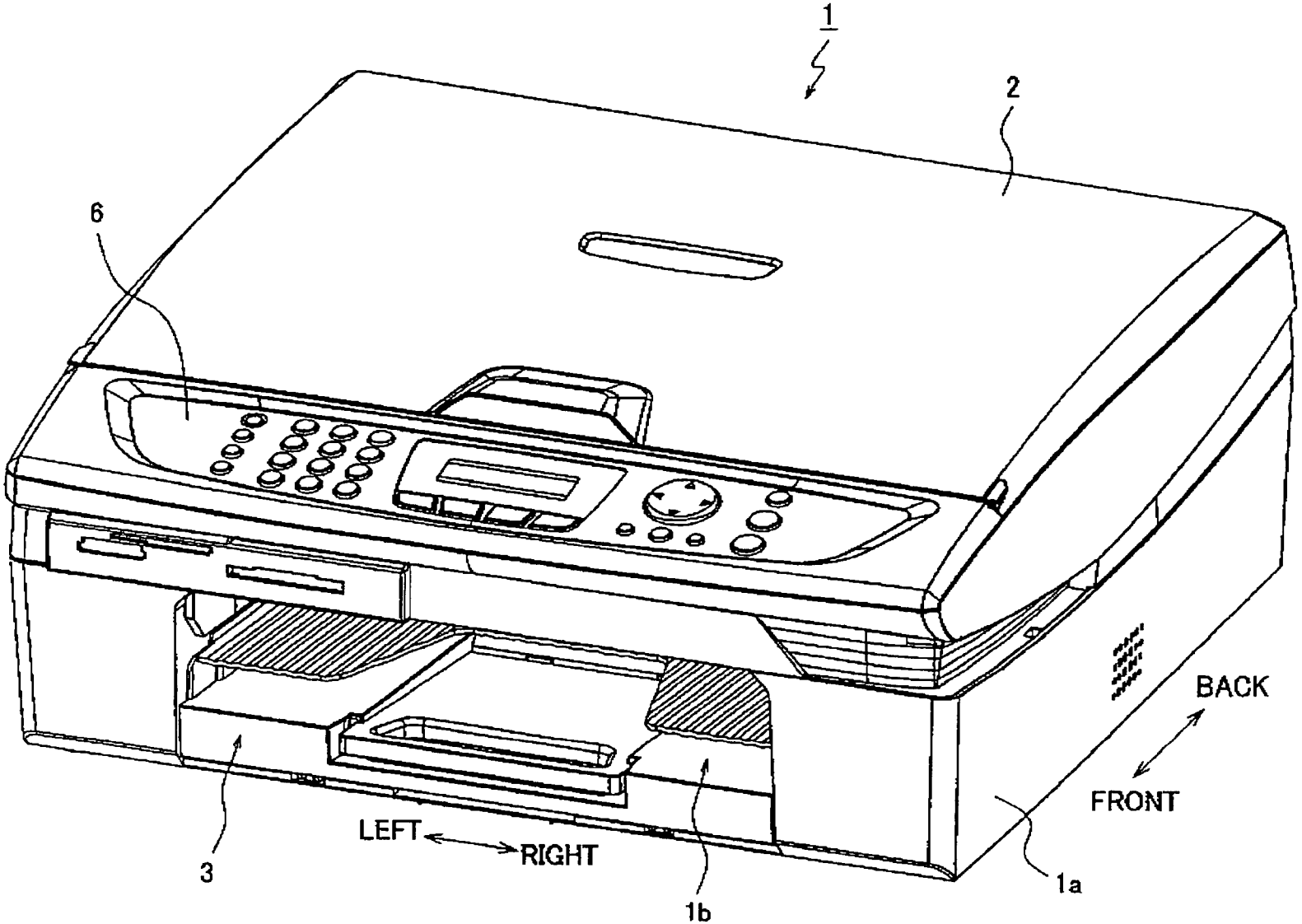
FIG. 1 is a perspective view showing an overall structure of a preferable inkjet recording apparatus for applying the present invention thereto.
Figure 2:
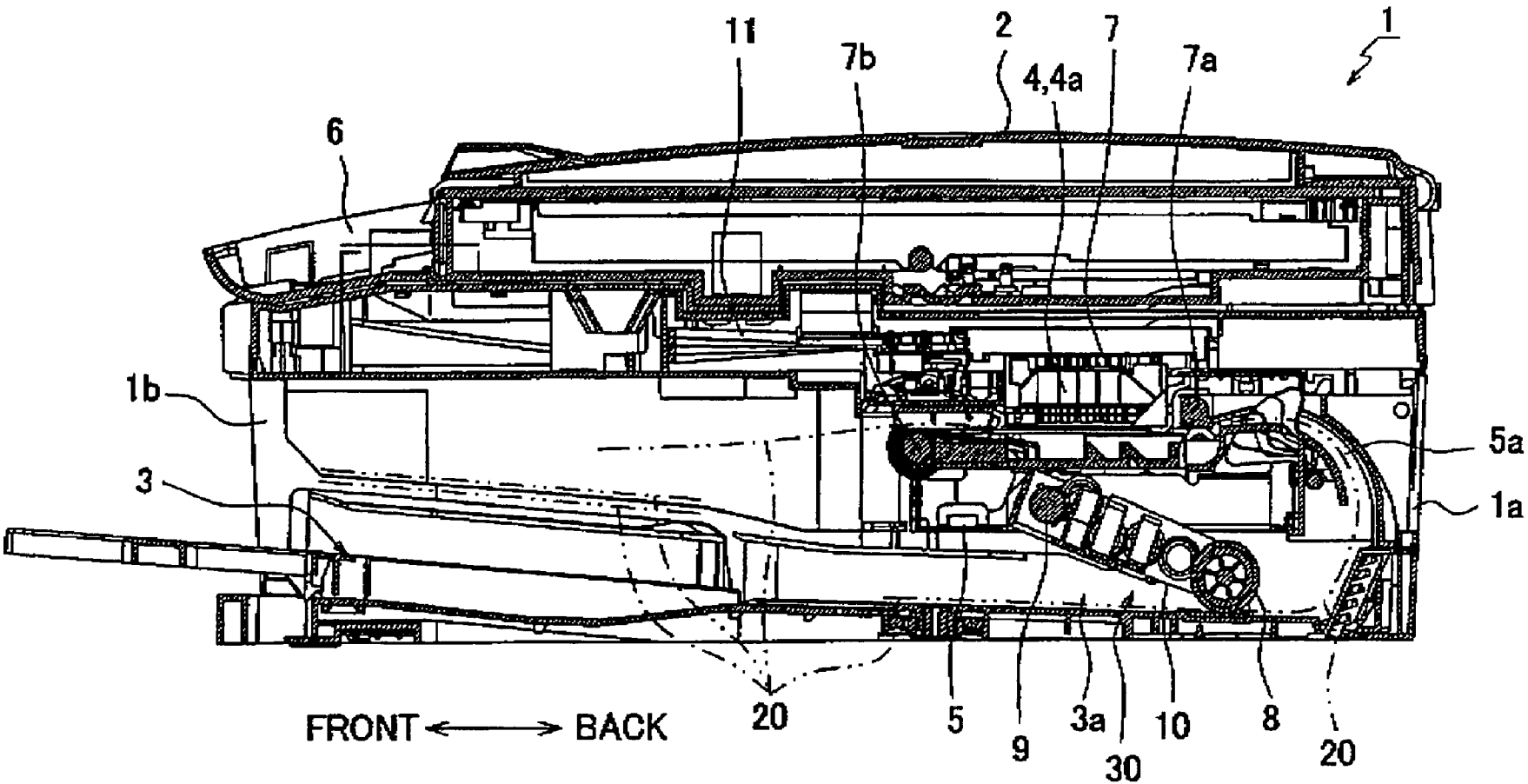
FIG. 2 is a sectional view showing an inkjet recording apparatus according to an embodiment of the present invention.

As shown in FIGS. 1 and 2, the inkjet recording apparatus 1 includes a scanner 2, a recording unit 7, and a paper feed device 30. The scanner 2 is disposed on a case 1*a*. The recording unit 7 is disposed under the scanner 2 (in the upper portion in the case 1*a*) so as to perform recording (image formation) on to a recording paper 40. The paper feed device 30 is disposed in the lower portion inside of the case 1*a*.

In the back side in the case 1*a* and above the paper feed device 30, a metal frame 5 is disposed. The frame 5 is approximately in a rectangular parallelepiped shape which is long in a left-to-right direction (a width direction to be described hereinafter). The frame 6 is secured inside of the case 1*a*.

In the upper portion in the frame 5, the recording unit 7 is disposed. The recording unit 7 includes a carriage 4*a* and recording heads 4 on the carriage 4*a* for performing image recording. In the recording unit 7, the carriage 4*a* is controlled by a control device 110 (not shown in FIG. 2, see FIG. 4) including a CPU 111, and reciprocated in the left-to-right direction (a main scanning direction). Corresponding to the reciprocation of the carriage 4*a*, the recording heads 4 are also moved. While the recording heads 4 are being moved, the recording heads 4 eject ink from nozzles, and record an image on to the recording paper 40 placed below the recording heads 4.

In a standby position of the carriage 4*a* in the recording unit 7, a maintenance unit (not shown) is disposed. The maintenance unit performs various maintenance operations, such as a wiping operation wherein a nozzle surface of the recording heads 4 is wiped by a blade or the like, a purging operation for forcibly removing dust, air, and solidified ink from inside of nozzles, a flushing operation for discharging ink, and so on.

Figures 3A, 3B:
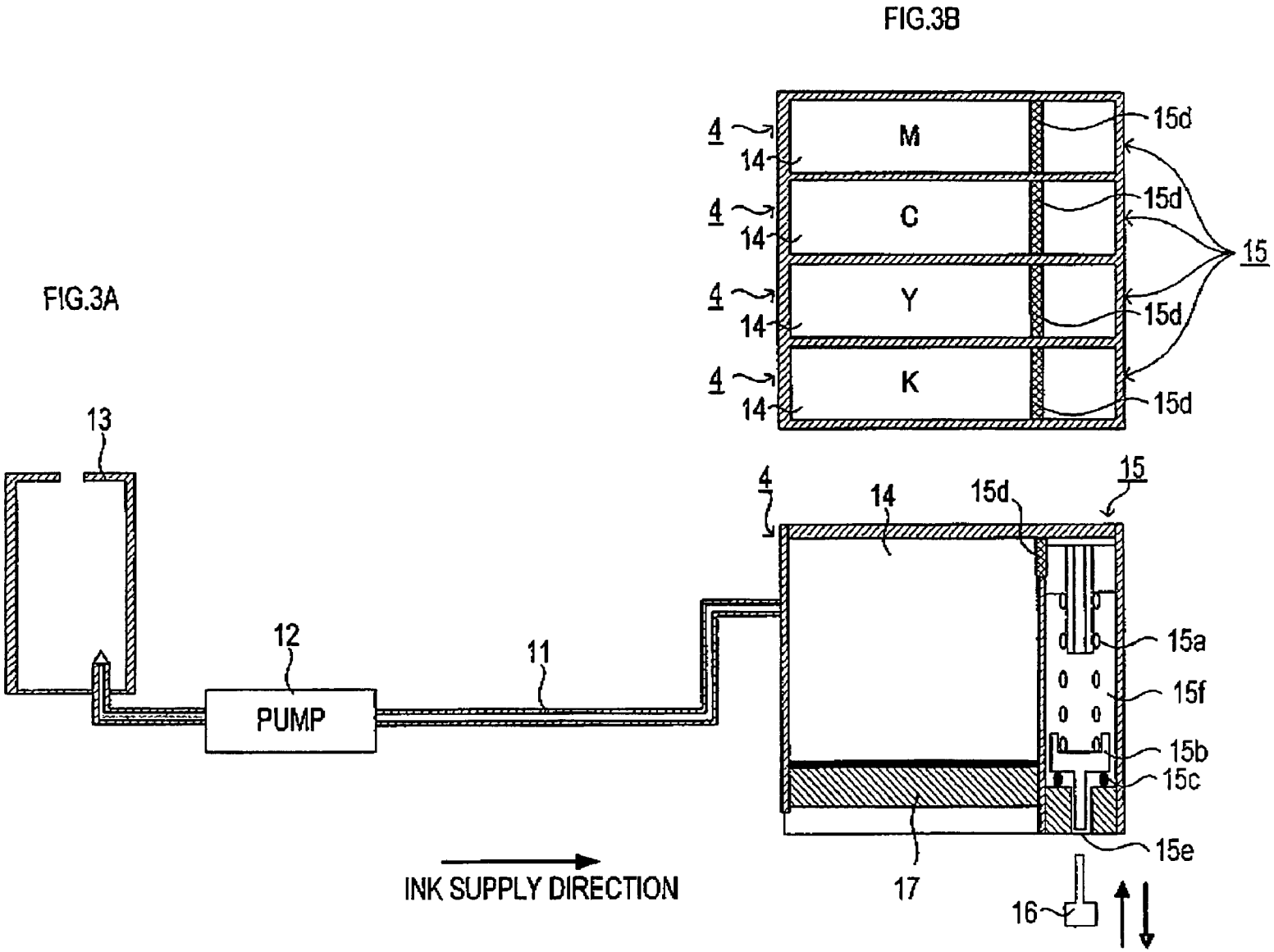

In the front portion inside of the case 1*a*, four ink cartridges 13 are disposed (not shown in FIG. 2, see FIG. 3A). Each of the ink cartridges 13 stores one of four colors of inks (black, cyan, magenta, and yellow) for full-color image recording. The ink cartridges 13 are configured to be attachable/detachable. The ink cartridges 13 are replaced in order to replenish the inks.

The inks stored in the respective ink cartridges 13 are supplied to the recording heads 4 through four ink supply tubes 11 connecting the respective ink cartridges 13 and the recording heads 4. The ink supply tubes 11 are designed to be able to follow the reciprocating movement of the carriage 4*a*.

Behind the frame 5, a conveyance path 5*a* is formed. The conveyance path 5*a* guides the recording paper 40 from the rear side of the paper feed device 30 to the recording unit 7. The recording unit 7 includes a conveyance roller 7*a* in a position adjacent to an outlet of the conveyance path 5*a*. The recording unit 7 furthermore includes a discharge roller 7*b* in a position where the recording paper 40 on which an image is recorded is discharged. The conveyance roller 7*a* can be rotated by rotational driving force of a paper conveyance motor 123 (not shown in FIG. 2, see FIG. 4).

The paper feed device 30 includes a paper feed cassette 3. The paper feed cassette 3 is set in the paper feed device 30 by being inserted from an opening portion 1*b* of the case 1*a* and thereby placed in the rear side inside of the case 1*a*. The paper feed cassette 3 is provided with a paper storing portion 3*a* so as to store piled recording paper 40.

The recording paper 40 on the top of the pile in the paper storing portion 3*a* is fed to the recording unit 7 through the conveyance path 5*a* by the rotation of the paper feed roller 8. The paper feed roller 8 is rotatably held on the leading end of a longitudinal arm 10 supported by a driving shaft 9. When the driving shaft 9 is rotated by the rotational driving force of a paper feed motor 122 (not shown in FIG. 2, see FIG. 4), the torque is transmitted to the paper feed roller 8, and the paper feed roller 8 is rotated.

In the upper front surface of the inkjet recording apparatus 1, an operation panel 6 is disposed. The operation panel 6 includes various operation buttons, and a liquid crystal panel. With the operation panel 6, user can select the operation mode of the inkjet recording apparatus 1, such as a printer mode, a copy mode, a scanner mode, and a facsimile mode. User can also specify various setting in respective operation mode, input necessary information (e.g., a facsimile number), and check the operation status of the inkjet recording apparatus 1 or the transmission status thereof.

[Description of Ink Supply Mechanism]

An ink supply mechanism of the inkjet recording apparatus 1 is used so as to supply inks into the four recording heads 4 (see FIG. 3B) each of which is predetermined to receive one of the magenta (M), cyan (C), yellow (Y), and black (K) inks from one of the ink cartridges 13 storing the corresponding color of ink. The four recording heads 4 are disposed on the carriage 4*a*. As shown in FIG. 3A, sub-tanks 14, respectively provided in the recording heads 4, and the ink cartridges 13 for the respective colors of inks are communicated with each other via ink supply tubes 11 and pumps 12 disposed on the ink supply tubes 11. That is, one ink supply tube 11 and one pump 12 are provided for each of the four recording heads 4. In FIG. 3B, only one recording head 4, one ink supply tube 11, and one pump 12 are shown so as to simplify the description.

Each of the recording heads 4 includes a plurality of nozzle portions 17, the sub-tank 14, and a valve unit 15. The nozzle portions 17 are disposed in the bottom side of the recording head 4. The sub-tank 14 reserves ink to be ejected from nozzles 17*h* (not shown in FIG. 3B, see FIGS. 5A and 5B) provided in each of the nozzle portions 17. The valve unit 15 is used so as to release/block atmospheric air into/from the sub-tank 14. The sub-tank 14 and the valve unit 15 are communicated with each other through an air permeable film 15*d*. The air permeable film 15*d* is a selective permeable film, and allows the passage of air but does not allow the passage of ink. Therefore, when the valve unit 15 releases the atmospheric air, only air flows between the sub-tank 14 and the valve unit 15, but ink does not leak from the sub-tank 14 into the valve unit 15.

The valve unit 15 includes a large diameter portion 15*f* disposed in the upper portion of the valve unit 15, and a ventilation hole 15*e* having a small diameter and disposed in the lower portion of the valve unit 15. In the large diameter portion 15*f*, a valve 15*b* is disposed such that the valve 15*b* can be ascended/descended. The valve 15*b* is formed with a valve body having a large diameter and a rod having a small diameter. An O-ring 15*c* for sealing, is interposed between the bottom surface of the valve body of the valve 15*b* and the surface where the ventilation hole 15*e* is provided. The valve 15*b* is constantly pressed downward by a spring 15*a*, such as a coil spring, disposed in the large diameter portion 15*f* above the valve 15. While the valve 15*b* is pressed downward, when the O-ring 15*c* is pressed by the valve body of the valve 15*b* to the upper end side of the ventilation hole 15*e*, the valve 15*b* comes into an air-blocking state. In this state, the rod of the valve 15*b* extends up to the vicinity of the opening at the lower end of the ventilation hole 15*e*. On the other hand, when a release rod 16, disposed in the standby position of the recording heads 4, is ascended so as to press the rod of the valve 15*b* upward against the biasing force of the spring 15*a*, the valve body of the valve 15*b* is moved away from the O-ring 15*c*. As a result, the valve 15*b* comes into an open state, that is an atmospheric air releasing state.

The pump 12 is a known pump constituted, for example, with a screw pump, vane pump, or the like. The pump 12 is disposed on the ink supply tube 11. The pump 12 can send the ink in two directions: in a direction wherein the ink is supplied from the ink cartridge 13 to the sub-tank 14 of the recording head 4 (to be referred to as the ink supply direction); and in a direction wherein the ink is returned from the sub-tank 14 to the ink cartridge 13.

[Electrical Structure of Inkjet Recording Apparatus 1]

Figure 4:
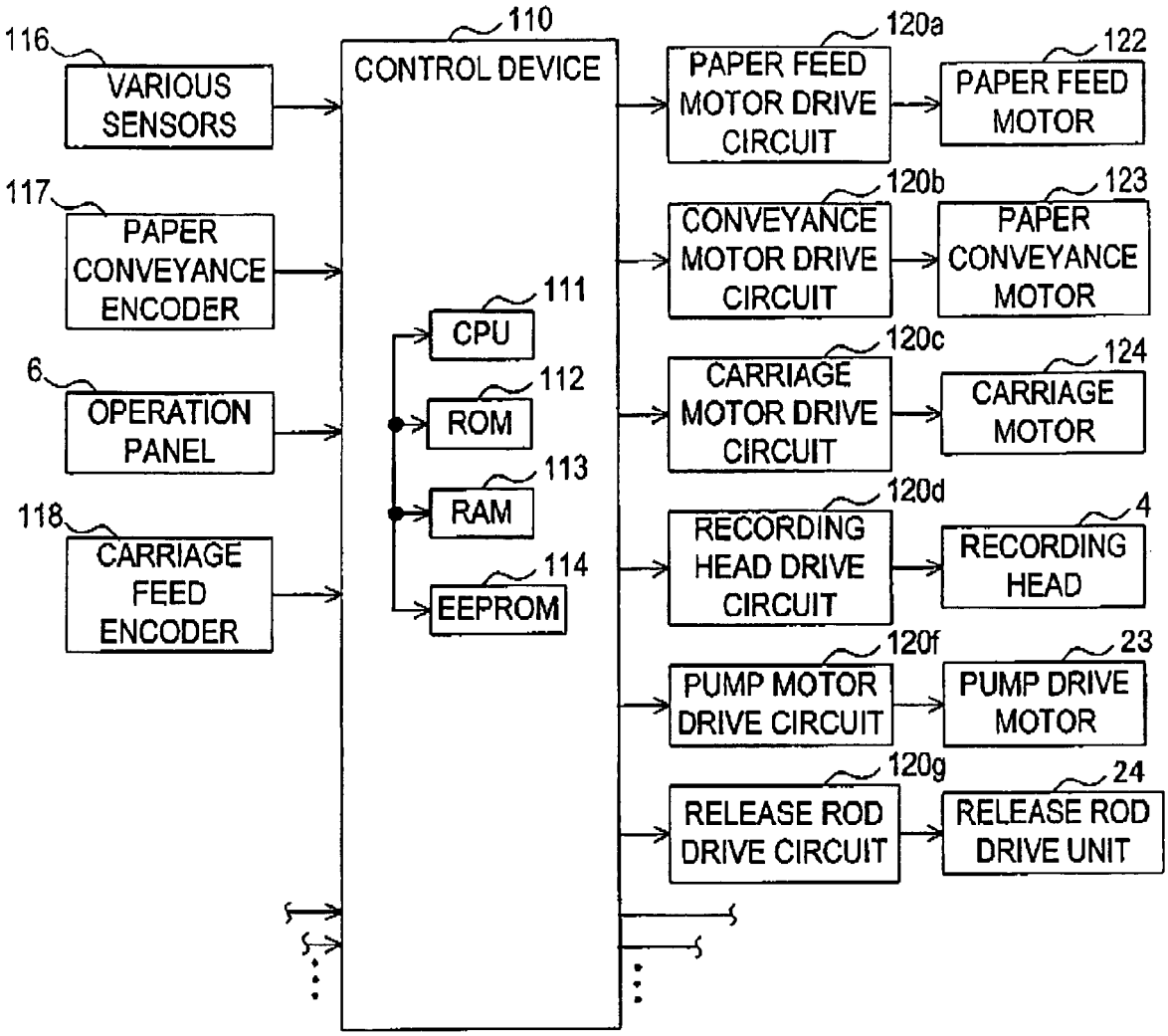
FIG. 4 is a block diagram showing an electric structure of the inkjet recording apparatus according to the embodiment.

As shown in FIG. 4, the inkjet recording apparatus 1 includes a control device 110 having a CPU 111, a ROM 112, a RAM 113, and an EEPROM 114, and configured as a known microcomputer.

The control device 110 is electrically connected with a group of various sensors 116, a paper conveyance encoder 117, the operation panel 6, a carriage feed encoder 118, and so on. The group of various sensors 116 includes a known media sensor and a resist sensor for detecting presence/absence of the recording paper 40, or the leading end, the trailing end, and ends in the width direction of the recording paper 40. The paper conveyance encoder 117 generates a signal for detecting the conveyance distance (position) of the recording paper 40 when the recording paper 40 is conveyed.

Furthermore, the control device 110 is electrically connected with each of a paper feed motor drive circuit 120*a*, a conveyance motor drive circuit 120*b*, a carriage motor drive circuit 120*c*, a recording head drive circuit 120*d*, a pump motor drive circuit 120*f*, and a release rod drive circuit 120*g*. The paper feed motor drive circuit 120*a* is used for driving the paper feed motor 122. The conveyance motor drive circuit 120*b* is used for driving the paper conveyance motor 123. The carriage motor drive circuit 120*c* is used for driving the carriage motor 124. The recording head drive circuit 120*d* is used for driving the recording heads 4 (i.e. piezoelectric elements 18 to be described hereinafter) (for ejecting ink). The pump motor drive circuit 120*f* is used for driving the pump driving motor 23. The release rod drive circuit 120*g* is used for driving the release rod drive unit 24.

When the CPU 111 controls respective drive circuits 120*a*-120*g* according to various programs stored in the ROM 112 or the EEPROM 114, respective driving targets are driven/controlled. As already described above, the paper feed roller 8 is driven by the rotation of the paper feed motor 122, and the conveyance roller 7*a* is driven by the rotation of the paper conveyance motor 123.

[Operation of Pump 12 and Release Rod 16]

In the above-described inkjet recording apparatus 1, the control device 110 controls the driving of the pump 12 and the release rod 16 so as to execute the ink supply operation, wherein the ink is supplied from the ink cartridge 13 to the ink supply tube 11 and the sub-tank 14, and to execute the purging operation, wherein the ink is forcibly removed from the nozzles of the recording head 4.

Specifically, by changing the rotational direction and the rotational speed of the pump 12, the ink conveyance direction and the pressure for conveyance are controlled.

In other words, for the ink supply operation, the control device 110 raises the release rod 16 so that the valve 15*b* comes into the atmospheric air releasing state. In this state, the control device 110 controls the driving of the pump 12 such that the ink flows in the ink supply direction. As a result, the ink in the ink cartridge 13 moves into the sub-tank 14 through the ink supply tube 11. At this time, the pressure inside of the sub-tank 14 slightly increases. However, since the valve 15*b* is in the atmospheric air releasing state, the pressure does not become larger than the pressure by which menisci of the inks inside of the nozzles are destroyed (equal to or more than 3.5 kPa in the present embodiment).

For the purging operation, the control device 110 lowers the release rod 16 so that the valve 15*b* comes into the air blocking state. In this state, the control device 110 controls the driving of the pump 12 such that the ink flows in the ink supply direction. Since the valve 15*b* is in the air blocking state, the pressure inside of the sub-tank 14 suddenly increases. The pressure becomes larger than the pressure by which the menisci of the inks in the nozzles are destroyed (for example, in the degree of 20 kPa). Then, the ink is forcibly discharged from the nozzles.

If the pressure inside of the sub-tank 14 can become even higher (for example, in the degree of 70 kPa), air which has entered the ink supply path between the sub-tank 14 and the nozzles can be preferably removed. However, the amount of ink discharged from the nozzles simultaneously becomes larger. That is, the ink is uselessly consumed. The amount of ink consumed in this case becomes approximately five times more than the volume of the ink supply path.

Therefore, the inkjet recording apparatus 1 according to the present embodiment is configured such that air (air bubbles) inside of the ink supply path can be preferably removed by devising the shape of the nozzle portion 17 (especially the ink supply path) without increasing the pressure inside of the sub-tanks 14. The following describes about this more in detail.

[Detailed Description of Nozzle Portion 17]

Figure 5A:
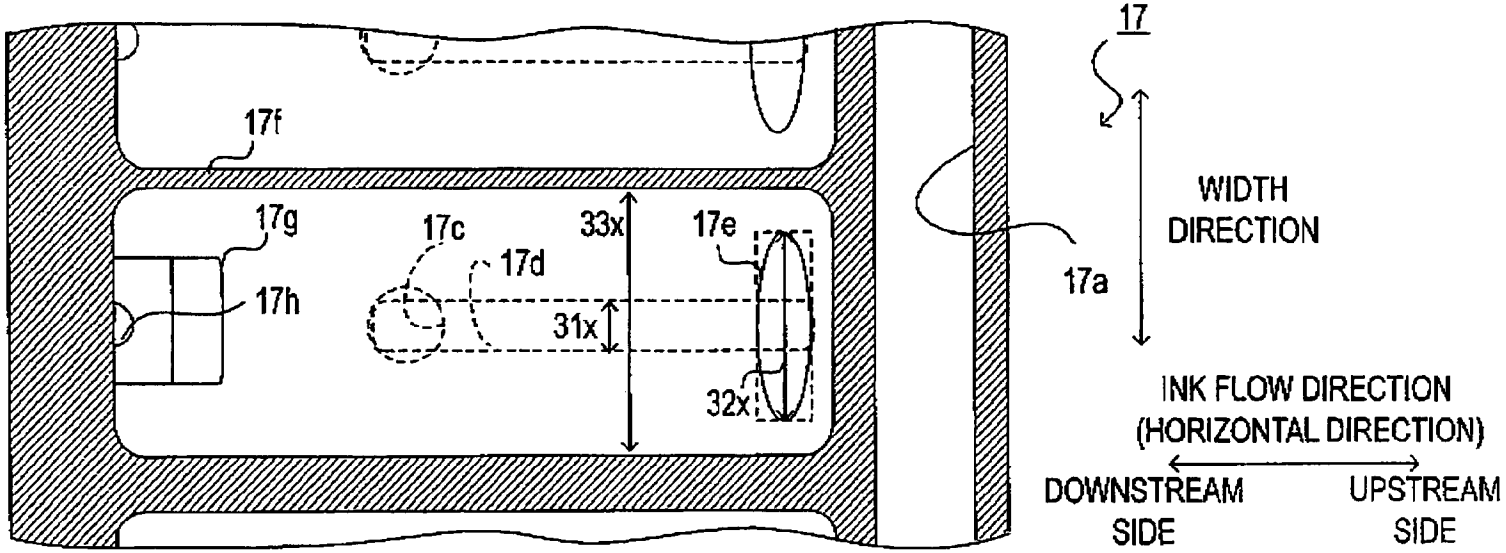
FIGS. 5A and 5B are sectional views in which 5A shows a sectional top view of a nozzle portion of the inkjet recording apparatus according to the embodiment, and in which 5B shows a sectional side view of the nozzle portion.
Figure 5B:
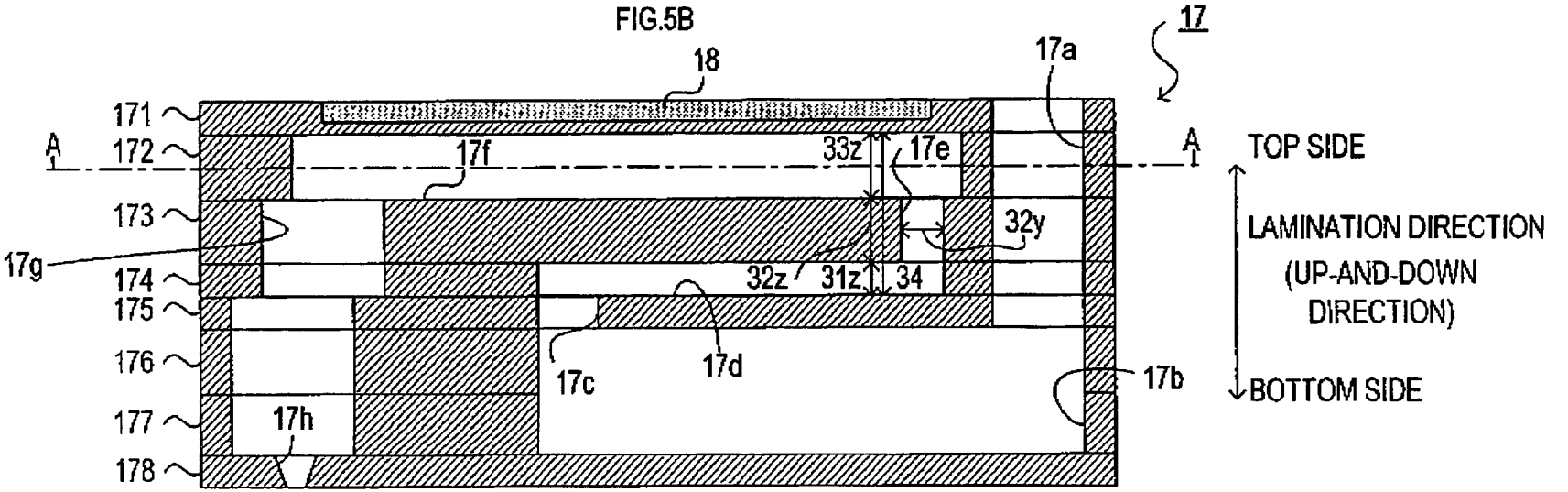

The nozzle portion 17 includes a number of nozzles 17*h* and a number of ink supply paths disposed in parallel (see FIG. 5A). Among all the nozzles 17*h* and the ink supply paths, one nozzle 17*h* and one ink supply path will be described below with reference to FIGS. 5A and 5B.

The nozzle portion 17 is formed with a plurality sheet of laminated members (in the present embodiment, eight laminated members: a first laminated member 171 to a eighth laminated member 178). An ink flow path is formed in advance on each of the laminated members 171-178 by etching or the like, and the laminated members 171-178 are laminated in order of the reference numbers. Therefore, the ink flow path is formed along a lamination direction of the laminated members 171-178 (an up-and-down direction shown in FIG. 5B), and a direction perpendicular to the lamination direction (an ink flow direction: a horizontal direction shown in FIG. 5A).

The nozzle portion 17 includes a nozzle 17*h*, a manifold 17*b* (as an ink reservoir), an ink replenishment path 17*a*, and an ink supply path. The nozzle 17*h* ejects the ink. The manifold 17*b* temporarily reserves the ink to be supplied into the nozzle 17*h*. The ink replenishment path 17*a* connects the sub-tank 14 and the manifold 17*b*, and functions as a path so as to supply the ink into the manifold 17*b*. The ink supply path connects the manifold 17*b* and the nozzle 17*h*. The ink supply path includes a restriction part 17*d*, a connecting portion 17*c*, a pressure chamber 17*f*, a coupling portion 17*e*, and a pressure transmission chamber 17*g*.

The nozzle 17*h* is formed on the eighth laminated member 178 laminated on the bottom.

The manifold 17*b* is configured by forming a space between the fifth laminated member 175 and the eighth laminated member 178 (that is, by forming a space on the sixth laminated member 176 and the seventh laminated member 177). The manifold 17*b* has a shape which is long in the width direction so that the ink can be supplied into other ink supply paths. In other words, the manifold 17*b* functions as a common liquid chamber for supplying the ink into adjacent ink supply paths.

The ink replenishment path 17*a* is configured by penetrating the first to the fifth laminated members 171-175. The ink replenishment path 17*a* is connected to an end portion of the manifold 17*b*.

The restriction part 17*d* is formed above the manifold 17*b*. The connecting portion 17*c* connects the manifold 17*b* and the restriction part 17*d*. The pressure chamber 17*f* is formed further above the restriction part 17*d*. The coupling portion 17*e* connects the restriction part 17*d* and the pressure chamber 17*f*. The pressure transmission chamber 17*g* connects the pressure chamber 17*f* and the nozzle 17*h*.

The connecting portion 17*c* is formed in the downstream side of the manifold 17*b* in the ink flow direction by providing a hole on the fifth laminated member 175.

The restriction part 17*d* is configured by forming a space between the third laminated member 173 and the fifth laminated member 175 (that is, on the fourth laminated member 174).

The pressure chamber 17*f* is configured by forming a space between the first laminated member 171 and the third laminated member 173 (that is, on the second laminated member 172). Above the pressure chamber 17*f*, a piezoelectric element 18 is disposed in the first laminated member 171.

The coupling portion 17*e* is formed in the upstream side of the pressure chamber 17*f* in the ink flow direction by providing a hole on the fifth laminated member 175 so as to be connected with the restriction part 17*d*.

The pressure transmission chamber 17*g* is configured in the downstream side of the pressure chamber 17*f* in the ink flow direction by penetrating the third to the seventh laminated members 173-177. The holes provided on the respective laminated members 173-177 in order to form the pressure transmission chamber 17*g* are not completely aligned. The holes provided on the laminated members disposed in the lower side in the lamination direction are positioned toward the left side in FIG. 5B. Due to the above-described shape of the pressure transmission chamber 17*g*, the flow resistance in the pressure transmission chamber 17*g* can be reduced. Therefore, when the pressure inside of the pressure chamber 17*f* changes by the driving of the piezoelectric element 18, the pressure change can be reliably transmitted to the nozzle 17*h*.

In other words, when the piezoelectric element 18 (the recording head 4) is driven by the control device 110, the pressure inside of the pressure chamber 17*f* changes. When the pressure inside of the pressure chamber 17*f* increases, the pressure change (the fluctuation of high pressure) reaches the nozzle 17*h* through the pressure transmission chamber 17*g*, and the ink is ejected from the nozzle 17*h*.

In the nozzle portion 17 according to the present embodiment, the sizes of the restriction part 17*d*, the coupling portion 17*e*, and the pressure chamber 17*f* are respectively set, for example, as below:

"width 31*x* of restriction part 17*d*"=80 μm,
"height 31*z* of restriction part 17*d*"=25 μm,
"width 32*x* of coupling portion 17*e*"=150 μm,
"depth 32*y* of coupling portion 17*e*"=40 μm,
"height 32*z* of coupling portion 17*e*"=50 μm,
"width 33*x* of pressure chamber 17*f*"=250 μm, and
"height 33*z* of pressure chamber 17*f*"=40 μm.

The above-indicated sizes satisfy each of the following conditions:

1. "depth 32*y* of coupling portion 17*e*"<"height 34 of coupling portion 17*e*" ("height 31*z* of restriction part 17*d*"+"height 32*z* of coupling portion 17*e*"+"height 33*z* of pressure chamber 17*f*"),
2. "width 31*x* of restriction part 17*d*"<"width 32*x* of coupling portion 17*e*"<"width 33*x* of pressure chamber 17*f*",
3. "height 31*z* of restriction part 17*d*"<"depth 32*y* of coupling portion 17*e*"≦"height 33*z* of pressure chamber 17*f*", and
4. "depth 32*y* of coupling portion 17*e*"<"width 32*x* of coupling portion 17*e*".

That is, the sizes of the restriction part 17*d* (the width 31x and the height 31*z*) are set smaller as compared to the sizes of the coupling portion 17*e* and the pressure chamber 17*f*. Therefore, the flow resistance in the restriction part 17*d* becomes larger than those in the coupling portion 17*e* and the pressure chamber 17*f*. As a result, even when the pressure inside of the pressure chamber 17*f* changes due to the driving of the piezoelectric element 18, the ink inside of the restriction part 17*d* is inhibited from reversely flowing toward the manifold 17*d*.

In addition, since the sizes of the restriction part 17*d*, the coupling portion 17*e*, and the pressure chamber 17*f* are determined so as to fit in the above conditions, the flow of air bubbles inside the nozzle portion 17 can be smoothened during the purging operation. The following describes this point more in detail with reference to FIGS. 6A and 6B.

Figure 6A:
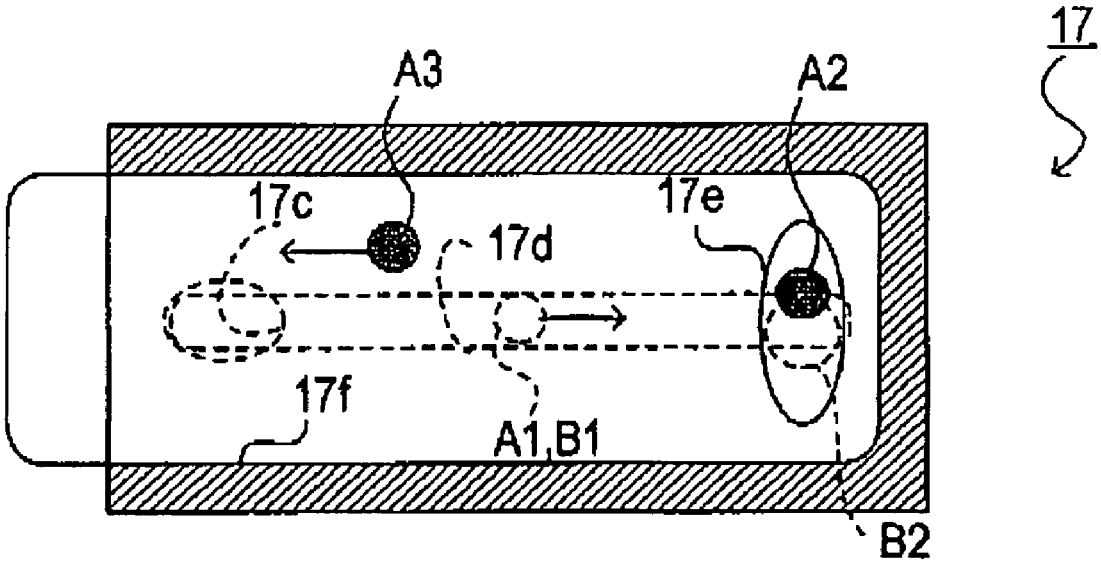
FIGS. 6A and 6B are explanatory views describing a flow of an air bubble in a purging operation inside of the nozzle portion of the inkjet recording apparatus according to the embodiment.
Figure 6B:
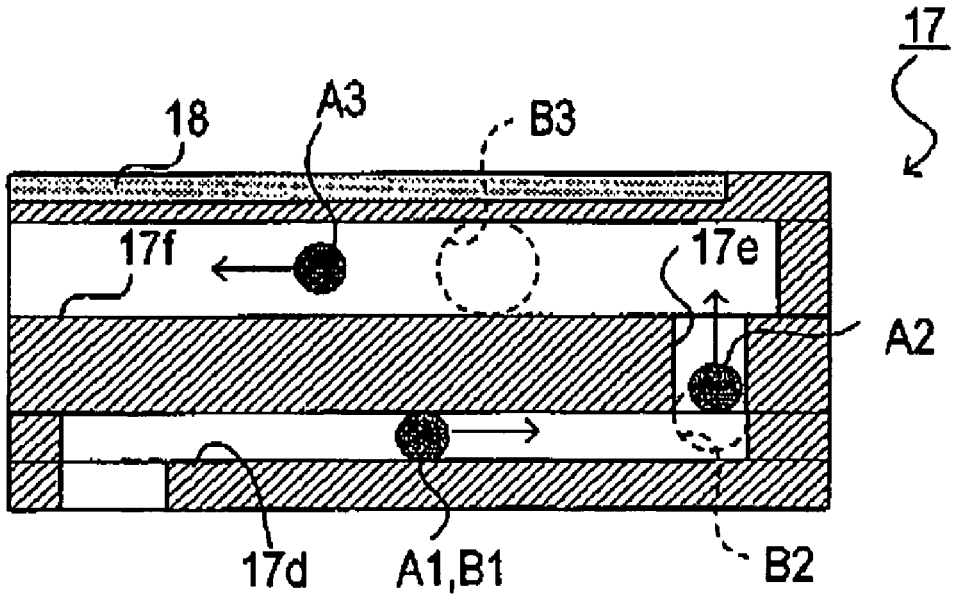

FIGS. 6A and 6B show an example wherein a spherical air bubble, having a diameter approximately equivalent to the height 31*z* of the restriction part 17*d*, has entered the restriction part 17*d*. In this case, the air bubble moves from the position A1 into the coupling portion 17*e* (to the position A2), and then into the pressure chamber 17*f* (to the position A3) along with the ink flow.

In this case, potential sizes of the air bubble in the restriction part 17*d*, the coupling portion 17*e*, and the pressure chamber 17*f* are respectively a size equivalent to the width 32*x* of the coupling portion 17*e* or the height 31*z* of the restriction part 17*d* (air bubble B1), a size equivalent to the width 32*x* of the coupling portion 17*e* or the depth 32*y* of the coupling portion 17*e* (air bubble B2), and a size equivalent to the width 33*x* of the pressure chamber 17*f* or the height 33*z* of the pressure chamber 17*f* (air bubble B3). In other words, the diameters of these air bubbles have the following relation:

"diameter of air bubble B1"<"diameter of air bubble B2"<"diameter of air bubble B3".

The air bubble in the position A1 is sequentially moved to larger areas. Therefore, in the inkjet recording apparatus 1, air bubbles can be moved without changing the shape thereof.

[Effect of the Present Embodiment]

The above-described inkjet recording apparatus 1 includes the recording heads 4 and the pumps 12, The recording heads 4 perform image recording onto a recording medium, such as paper, by supplying the ink reserved in the manifolds 17*b* to the nozzles 17*h* through the ink supply paths and selectively ejecting the ink from the nozzles 17*h*. The pumps 12 discharge the ink inside of the ink supply paths from the nozzles 17*h*, and thereby remove air which has entered the ink supply paths.

In the recording heads 4, the ink supply paths respectively include the pressure chamber 17*f*, the restriction part 17*d*, and the coupling portion 17*e*. The pressure chamber 17*f* is provided with the piezoelectric element 18 which is laminated above the pressure chamber 17*f*, and changes the pressure inside of the ink supply path so as to eject the ink inside of the ink supply path from the nozzle 17*h*. The restriction part 17*d* is disposed above the manifold 17*b* and below the pressure chamber 17*f* so as to inhibit the ink inside of the pressure chamber 17*f* from reversely flowing toward the manifold 17*b*. The coupling portion 17*e* connects the pressure chamber 17*f* and the restriction part 17*d*. In the respective ink supply paths, the depth 32*y* of the coupling portion 17*e*, which is the size of the coupling portion 17*e* in the depth direction parallel to the ink flow direction in the pressure chamber 17*f*, is set smaller than the height 34 of the coupling portion 17*e*, which is the size of the coupling portion 17*e* in the up-and-down direction parallel to the ink flow direction in the coupling portion 17*e* ("height 31*z* of the restriction part 17*d*"+"height 32*z* of the coupling portion 17*e*"+"height 33*z* of the pressure chamber 17*f*").

That is, in the respective recording heads 4 described above, even when air (air bubbles) is accumulated in the respective joint portions of the restriction part 17*d*, the coupling portion 17*e*, and the pressure chamber 17*f*, air bubbles do not grow larger than the sizes of the spaces formed by the restriction part 17*d*, the coupling portion 17*e*, and the pressure chamber 17*f*.

Therefore, according to the inkjet recording apparatus 1 including such recording heads 4, the size of air bubbles, which can exist in the spaces formed by the restriction part 17*d*, the coupling portion 17*e*, and the pressure chamber 17*f* (the space defined by the depth 32*y* of the coupling portion 17*e* and the height 34 of the coupling portion), can be limited. Therefore, the resistance generated when air bubbles, which have entered the restriction part 17*d* or the coupling portion 17*e*, are moved toward the pressure chamber 17*f* can be reduced. As a result, air (air bubbles) accumulated in the ink supply path can be removed simply by discharging a small amount of ink.

Moreover, in the recording heads 4 according to the present embodiment, the height 31*z* of the restriction part 17*d* is set to be equal to or smaller than the depth 32*y* of the coupling portion 17*e*. The depth 32*y* is set smaller than the height 33*z* of the pressure chamber 17*f*. In the restriction part 17*d*, the width 31*x*, which is the size of the restriction part 17*d* in the width direction perpendicular to the depth direction (ink flow direction) and the up-and-down direction, is set smaller than the width 32*x* of the coupling portion 17*e*, which is the size of the coupling portion 17*e* in the width direction. The width 32*x* of the coupling portion 17*e* is set smaller than the width 33*x* of the pressure chamber 17*f* which is the size of the pressure chamber 17*f* in the width direction.

Therefore, according to the above-described recording heads 4, the shape of the ink supply path is set such that air bubbles do not have to be squashed. The resistance generated when air bubbles which have entered the ink supply path are moved, can be reduced even more. As a result, air (air bubbles) accumulated in the ink supply path can be easily removed simply by discharging a small amount of ink.

Furthermore, in the recording heads 4 according to the present embodiment, the height 32*z* of the coupling portion 17*e*, obtained by subtracting the height 31*z* of the restriction part 17*d* and the height 33*z* of the pressure chamber 17*f* from the height 34 of the coupling portion 17*e*, is set smaller than the width 32*x* of the coupling portion 17*e* which is the size of the coupling portion 17*e* in the width direction.

Still furthermore, in the recording heads 4 according to the present embodiment, the coupling portion 17*e* is configured such that the shape of a horizontal section at any part of the coupling portion 17*e* is an oval or a rectangular shape.

As a result, according to such recording head 4, the resistance generated when air bubbles which have entered in the ink supply path are moved can be more reliably reduced.

[Description of Variation]

The present invention is not limited to the above-described embodiment. Variations are possible within the technical scope of the present invention.

For example, in the above-described embodiment, the purging operation is performed wherein the control unit 110 drives the pumps 12 so as to push out the ink inside of the nozzle portions 17. However, the structure is not limited to the one described above. For instance, a suction device may be provided in a predetermined position of the inkjet recording apparatus 1. For purging operation, the control device 110 can drive the suction device so as to draw the ink from the respective nozzles 17*h*.

With this structure, the same effect can be achieved as in the inkjet recording apparatus 1 according to the above-described embodiment.

Although the specific embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. A recording head comprising:

an ink reservoir that reserves ink;

ejection nozzles that eject ink; and at least one ink supply path through which ink, reserved in the ink reservoir, is supplied to the ejection nozzles;

wherein the ink supply path includes:

a pressure chamber provided with a piezoelectric element for changing pressure inside of the ink supply path in order to eject ink in the ink supply path from the ejection nozzles;

a restriction part disposed between the ink reservoir and the pressure chamber so as to inhibit ink in the pressure chamber from reversely flowing toward the ink reservoir; and a coupling portion connecting the pressure chamber and the restriction part; and wherein the restriction part, the coupling portion, and the pressure chamber are designed such that sizes of respective portions of the ink supply path, perpendicular to the flow of the ink, become larger in order of the restriction part, the coupling portion, and the pressure chamber.

2. The recording head set forth in claim 1;

wherein the ink supply path includes:

a connection between the restriction part and the coupling portion; and a connection between the coupling portion and the pressure chamber respectively arranged in a bent manner.

3. The recording head as set forth in claim 1;

wherein a depth of the coupling portion, which is a size of the coupling portion in a depth direction parallel to an ink flow direction in the pressure chamber, is smaller than a height of the coupling portion, which is a size of the ink supply path in the coupling portion in an up-and-down direction parallel to the ink flow direction in the coupling portion.

4. The recording head as set forth in claim 3;

wherein a height of the restriction part is equivalent to or smaller than the depth of the coupling portion; and wherein the depth of the coupling portion is smaller than a height of the pressure chamber.

5. The recording head as set forth in claim 3;

wherein a width of the restriction part, which is a size of the restriction part in a width direction perpendicular to the depth direction and the up-and-down direction, is smaller than a width of the coupling portion, which is a size of the coupling portion in a width direction; and wherein the width of the coupling portion is smaller than a width of the pressure chamber, which is a size of the pressure chamber in a width direction.

6. The recording head as set forth in claim 3;

wherein the height of the coupling portion excluding the height of the restriction part and the height of the pressure chamber is set smaller than the width of the coupling portion, which is the size of the coupling portion in the width direction.

7. The recording head as set forth in claim 6;

wherein the coupling portion has an oval section when the coupling portion is cut in a horizontal direction at an arbitrary position thereof.

8. The recording head as set forth in claim 6;

wherein the coupling portion has a rectangular section when the coupling portion is cut in a horizontal direction at an arbitrary position thereof.

9. An inkjet recording apparatus comprising:

a recording head according as set forth in claim 1;

an image recording unit that performs image recording with the recording head while the recording head is moved in relation with a recording medium; and an air removal unit that removes air, which has entered the ink supply path, by discharging ink in the ink supply path from the ejection nozzles.

10. A recording head comprising:

an ink reservoir that reserves ink;

ejection nozzles that eject ink; and at least one ink supply path through which ink, reserved in the ink reservoir, is supplied to the ejection nozzles;

wherein the ink supply path includes:

a pressure chamber provided with a piezoelectric element for changing pressure inside of the ink supply path in order to eject ink in the ink supply path from the ejection nozzles;

a restriction part disposed between the ink reservoir and the pressure chamber so as to inhibit ink in the pressure chamber from reversely flowing toward the ink reservoir; and a coupling portion connecting the pressure chamber and the restriction part; and wherein a depth of the coupling portion, which is a size of the coupling portion in a depth direction parallel to an ink flow direction in the pressure chamber, is smaller than a height of the coupling portion, which is a size of the ink supply path in the coupling portion in an up-and-down direction parallel to the ink flow direction in the coupling portion.

11. The recording head set forth in claim 10;

wherein the ink supply path includes:

a connection between the restriction part and the coupling portion; and a connection between the coupling portion and the pressure chamber respectively arranged in a bent manner.

12. The recording head as set forth in claim 10;

wherein a height of the restriction part is equivalent to or smaller than the depth of the coupling portion, and wherein the depth of the coupling portion is smaller than a height of the pressure chamber.

13. The recording head as set forth in claim 10;

wherein a width of the restriction part, which is a size of the restriction part in a width direction perpendicular to the depth direction and the up-and-down direction, is smaller than a width of the coupling portion, which is a size of the coupling portion in a width direction; and wherein the width of the coupling portion is smaller than a width of the pressure chamber, which is a size of the pressure chamber in a width direction.

14. The recording head as set forth in claim 10;

wherein the height of the coupling portion excluding the height of the restriction part and the height of the pressure chamber is set smaller than the width of the coupling portion, which is the size of the coupling portion in the width direction.

15. The recording head as set forth in claim 14;

wherein the coupling portion has an oval section when the coupling portion is cut in a horizontal direction at an arbitrary position thereof.

16. The recording head as set forth in claim 14;

wherein the coupling portion has a rectangular section when the coupling portion is cut in a horizontal direction at an arbitrary position thereof.

17. An inkjet recording apparatus comprising:

a recording head according as set forth in claim 10;

an image recording unit that performs image recording with the recording head while the recording head is moved in relation with a recording medium; and an air removal unit that removes air, which has entered the ink supply path, by discharging ink in the ink supply path from the ejection nozzles.

* * * * *